United States Patent [19]

Jaeger et al.

[11] 4,157,307

[45] Jun. 5, 1979

[54] LIQUID FABRIC SOFTENER

[75] Inventors: Mark S. Jaeger; James E. Davis, both of Cincinnati, Ohio

[73] Assignee: The Procter & Gamble Company, Cincinnati, Ohio

[21] Appl. No.: 931,588

[22] Filed: Aug. 7, 1978

[51] Int. Cl.[2] ..... D06M 13/34

[52] U.S. Cl. ..... 252/8.75; 252/8.8

[58] Field of Search ..... 252/8.75, 8.8

[56] References Cited

U.S. PATENT DOCUMENTS

| | | | |
|---|---|---|---|
| 3,729,416 | 4/1973 | Bruning | 252/8.8 |
| 3,756,950 | 9/1973 | Gluck | 252/8.75 |
| 3,850,818 | 11/1974 | Katsumi et al. | 252/8.8 |
| 3,879,300 | 4/1975 | Renold | 252/8.8 |
| 3,904,533 | 9/1975 | Neiditch et al. | 252/8.8 |
| 3,954,634 | 5/1976 | Monson et al. | 252/8.8 |
| 4,076,632 | 2/1978 | Davis | 252/8.8 |

*Primary Examiner*—William E. Schulz

*Attorney, Agent, or Firm*—Richard C. Witte; Thomas H. O'Flaherty; William H. Gould

[57] ABSTRACT

Liquid fabric conditioning compositions having good chemical and physical stability are provided by low pH mixtures of a quaternary ammonium salt, a quaternary imidazolinium salt, protonated di-polyethoxy monoalkyl amine, a lower alcohol, and water.

8 Claims, No Drawings

LIQUID FABRIC SOFTENER

TECHNICAL FIELD

This invention relates to compositions and methods for conditioning fabrics during the rinse cycle of home laundering operations. This is a widely used practice to impart to laundered fabrics a texture or handle that is smooth, pliable and fluffy to the touch (i.e. soft) and also to impart to the fabrics a reduced tendency to pick up and/or retain an electrostatic charge (i.e. static control), especially when the fabrics are dried in an automatic dryer.

It has become commonplace today for homemakers to use fabric conditioning compositions comprising major amounts of water, lesser amounts of fabric conditioning agents, and minor amounts of optional ingredients such as perfumes, colorants, preservatives and stabilizers. Such compositions are aqueous suspensions or emulsions which can be conveniently added to the rinsing bath of home laundry operations.

BACKGROUND ART

Davis disclosed in U.S. Pat. No. 4,076,632 issued Feb. 28, 1978 a liquid fabric softening composition comprising cationic fabric softener, protonated di-polyethoxy monoalkyl amine, urea, and water. Among Davis' cationics were quaternary ammonium salts, quaternary imidazolinium salts, and mixtures thereof. Solvents such as alcohols, glycols and glycol ethers were used optionally.

Particular merit has been found for utilizing certain mixtures of quaternary ammonium salts with quaternary imidazolinium salts. Imidazolinium salts are superior to ammonium salts in softening ability on synthetic fabrics such as polyester and cotton/polyester blends, and are also superior in antistat properties which are particularly important for fabrics containing synthetic fibers. However imidazolinium salts tend to be more expensive than ammonium salts, and hence a mixture of the two types represents a good economic balance. However a pH-incompatability problem has now been found with certain compositions that utilize imidazolinium salts, and a pH of about 5.5 and below is desired. However, a pH below about 3.5 causes urea to become unstable and release ammonia, which causes not only an odor frequently considered unpleasant but also a diminution of the freeze-thaw stability that the urea was used to achieve. Complete replacement of urea with solvents, in conjunction with the protonated di-polyethoxy monoalkyl amine, provides the required freeze-thaw stability at these unusually low pH's.

DISCLOSURE OF INVENTION

The present invention relates to fabric conditioning compositions in liquid form for use in home laundry operations. These compositions comprise four essential components: (a) from about 3% to about 12%, preferably from 4% to 8%, of a cationic fabric conditioning agent; (b) from about 0.2% to about 1.3%, preferably from 0.4% to 1.0%, of protonated di-polyethoxy monoalkyl amine; (c) from about 1% to about 6%, preferably from 3% to 5%, of a lower alcohol as hereinafter defined; and (d) the balance chiefly water. The cationic fabric conditioning agent is comprised of a mixture of (i) quaternary ammonium salt, and (ii) quaternary imidazolinium salt. The weight ratio of (i):(ii) is from 1:1.5 to about 4:1; preferably from 1.5:1 to 2.5:1. The pH of the composition is from about 3.5 to about 5.5, preferably from 4.0 to 4.8. Minor amounts of other materials often used in liquid fabric conditioners can also be present, such as colorants, perfumes, preservatives, and optical brighteners. In the foregoing recitation, all percentages are by weight based on the complete fabric conditioning composition.

In its method aspect, this invention provides a process of treating fabrics with the compositions defined above.

DETAILED DESCRIPTION OF THE INVENTION

The compositions of the present invention contain, as components (a), cationic fabric conditioning agent. By fabric conditioning is meant both fabric softening and fabric antistat effects. Fabric conditioning agents, generally, are organic waxy materials having a melting-/softening point between about 25° C. and about 115° C., and are dispersible but not soluble in water.

The amount of fabric conditioning agent in the compositions of this invention is from about 3% to about 12%, preferably from 4% to 8%, by weight of the composition. The lower limits are amounts needed to contribute effective fabric conditioning performance when added to laundry rinse baths in the manner which is customary in home laundry practice. The upper limits are amounts beyond which physical instability problems arise in connection with storage of the liquid compositions. It will be appreciated that the conditions of storage greatly affect stability, and the formulator of fabric conditioning compositions with ordinary skill in the art can readily determine compositions having sufficient physical stability for his particular climate and warehouse storage conditions. By physical stability herein is meant the ability of a composition to maintain a homogeneous condition for long periods of storage. In commercial practice, such storage may be at various temperatures that hold approximately constant both above and below the normal ambient, and also at various cycling temperatures including those below the freezing point.

The fabric conditioning agent of this invention is comprised of two components, (i) quaternary ammonium salt, and (ii) quaternary imidazolinium salt. The quaternary ammonium salt has the formula:

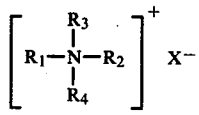

wherein $R_1$ is hydrogen or an aliphatic group having from 1 to 22 carbon atoms; $R_2$ is an aliphatic group having from 10 to 22 carbon atoms; $R_3$ and $R_4$ are each alkyl groups having from 1 to 3 carbon atoms; and X is an anion selected from the halogen, acetate, phosphate, nitrate and methyl-sulfate radicals.

Representative examples of quaternary ammonium salts which constitute component (i) of this invention include tallow trimethyl ammonium chloride; ditallow dimethyl ammonium chloride; ditallow dimethyl ammonium methyl sulfate; dihexadecyl dimethyl ammonium chloride; di(hydrogenated tallow) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate;

dihexadecyl diethyl ammonium chloride; dihexadecyl dimethyl ammonium acetate; ditallow dipropyl ammonium phosphate; ditallow dimethyl ammonium nitrate; and di(coconut-alkyl) dimethyl ammonium chloride.

An especially preferred quaternary ammonium fabric conditioning agent is ditallow dimethyl ammonium chloride that is commercially available from General Mills, Inc. under the tradename ALIQUAT-2HT and from Ashland Oil, Inc. as ADOGEN 448.

The quaternary imidazolinium salts which constitute component (ii) of this invention have the formula:

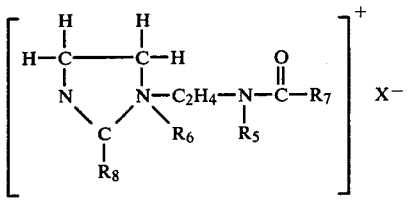

wherein $R_6$ is an alkyl group having from 1 to 4, preferably from 1 to 2 carbon atoms, $R_5$ is an alkyl group having from 1 to 4 carbon atoms or a hydrogen radical, $R_8$ is an alkyl group having from 1 to 22, preferably at least 15 carbon atoms or a hydrogen radical, $R_7$ is an alkyl group having from 8 to 22, preferably at least 15 carbon atoms, and X is an anion, preferably methylsulfate or chloride ions. Other suitable anions include those disclosed with reference to the cationic quaternary ammonium fabric antistat/softeners described hereinbefore. Particularly preferred are those imidazolinium compounds in which both $R_7$ and $R_8$ are alkyl groups having from 12 to 22 carbon atoms, e.g., 1-methyl-1-[(stearoylamide)ethyl]-2-heptadecyl-4,5-dihydroimidazolinium methylsulfate and 1-methyl-1 -[(palmitoylamide)ethyl]-2-octadecyl-4,5-dihydroimidazolinium chloride.

An especially preferred quaternary imidazolinium fabric conditioning agent is 2-tallow-1-methyl-1-(tallow-amidoethyl) imidazoline methylsulfate having the structure:

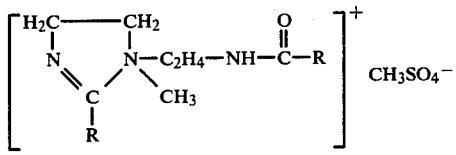

where R is an alkyl group derived from tallow. This material is commercially available from the Ashland Oil Co. under the trade name VARISOFT-445.

The weight ratio of quaternary ammonium salt to quaternary imidazolinium salt in the composition of this invention is from about 1:1.5 to about 4.1. At ratios lower than this the higher cost of the imidazolinium salt becomes economically unattractive, while at ratios higher than this the superior conditioning performance contributed by the imidazolinium salt diminishes perceptibly. Ratios from 1.5:1 to 2.5:1 are preferred.

Component (b) of this invention is protonated di-polyethoxy monoalkyl amine:

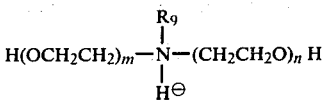

$R_9$ is an alkyl group, preferably having from about 10 to about 20 carbon atoms, most preferably from about 14 to about 18 carbon atoms; and the sum (m +n) is preferably from about 10 to about 40, most preferably from about 16 to about 30, where m and n are each integers greater than 1.

The amount of protonated di-polyethoxy monoalkyl amine in the compositions of this invention is from about 0.2% to about 1.3%, preferably from 0.4% to 1.0%, by weight of the composition. In conjunction with the lower alcohol hereinbelow described, it provides physical stability to the composition, especially at elevated temperatures and in multiple freeze-thaw cycles. From 0.4% to 1.0% by weight of the composition is preferred. Incorporation of said protonated amine is ordinarily accomplished by adding the corresponding free, unprotonated amine to the remainder of the composition which is acidic in nature.

Di-polyethoxy monoalkyl amine is made by ethoxylating monoalkyl amine in a conventional manner. An especially preferred amine has an alkyl group derived from tallow and the sum (m+n) is equal to 23. This amine is commercially available from Daiichi Kogyo Seiyaku Co., Ltd. of Japan under the trade name AMILADIN-D.

Component (c) of this invention comprises from about 1% to about 6%, preferably from 3% to 5%, by weight of the composition of a lower alcohol. By lower alcohol herein is meant monohydroxy alkanes having from 1 to about 6 carbon atoms in either straight or branched chain configuration, for example ethanol, isopropanol, and n-hexanol; dihydroxy alkanes having from 2 to about 8 carbon atoms, for example propylene glycol and 1,4-dihydroxy octane; and glycol ethers having from about 4 to about 16 carbon atoms, for example diethylene glycol monoethyl ether and polyethylene glycol having an average molecular weight of 370. Ethylene glycol is a preferred lower alcohol.

In addition to components (a), (b) and (c) as hereinbefore defined, the balance of the compositions of this invention is chiefly comprised of component (d), water. Water is the medium in which the essential components (a), (b) and (c), and the optional components, are dissolved, suspended or dispersed. Since minerals or other impurities in the water can react with certain of the other essential or optional composition components, it may be preferable to utilize deionized or soft water in the compositions herein.

Optional components of the liquid fabric conditioning compositions of this invention are conventional in nature, and generally comprise from about 0.1% to about 10% by weight of the composition. Such optional components include, but are not limited to colorants, perfumes, preservatives, optical brighteners, opacifiers, viscosity modifiers, fabric conditioning agents in solid form such as clay, emulsifiers, stabilizers, shrinkage controllers, spotting agents, germicides, fungicides, anti-corrosion agents, etc.

The pH of the compositions of this invention is from 3.5 to about 5.5. The preferred pH range is from 4.0 to 4.8. Adjustment of pH is normally carried out by including a small quantity of free acid in the formulation. Because no strong pH buffers are present, only traces of acid, often in the ppm range, are required. Any acidic material can be used; its selection can be made by anyone skilled in the softener arts on the basis of cost, availability, safety, etc. Among the acids that can be used are hydrochloric, sulfuric, phosphoric, citric, maleic, and succinic. For the purposes of this invention, pH is measured by a glass electrode in full strength softening composition in comparison with a standard calomel reference electrode.

The liquid fabric conditioning compositions of the present invention can be prepared by conventional methods. Homogenizing is not necessary. A convenient and satisfactory method is to prepare a quaternary salt premix at about 140° F. which is then added to a hot aqueous solution of the other ingredients. Temperature-sensitive optional components can be added after the fabric conditioning composition is cooled to room temperature or thereabouts.

The liquid fabric conditioning compositions of this invention are used by adding to the rinse cycle of conventional home laundry operations. Generally, rinse water has a temperature of from about 5° C. to about 60° C. The concentration of the cationic fabric conditioners of this invention is generally from about 2 ppm to about 200 ppm, preferably from about 10 ppm to about 100 ppm, by weight of the aqueos rinsing bath.

In general, the present invention in its fabric conditioning method aspect comprises (a) washing fabrics in a conventional washing machine with a detergent composition; (b) rinsing the fabrics; (c) adding during the rinsing stage of the operation the above-described amounts of cationic fabric conditioners in an aqueous liquid composition containing specified amounts of protonated dipolyethoxymonoalkyl amine and lower alcohol as hereinbefore defined; and (d) drying the fabrics.

The detergent composition normally contains an anionic, nonionic, amphoteric or ampholytic surfactant or a mixture thereof, and frequently contains in addition an organic or inorganic builder. When multiple rinses are used, the fabric conditioning composition is preferably added to the final rinse. Fabric drying can take place either in the open air or in an automatic dryer.

The following examples illustrate the aqueous liquid fabric conditioning compositions and methods of this invention and the benefits achieved by the utilization of such compositions and methods. These examples are illustrative of the invention herein and are not to be construed as limiting thereof.

EXAMPLE 1

Example 1 was prepared by the following process:

A softener premix was prepared as follows: 5.45 parts of commercial dimethyl ditallow ammonium chloride [Adogen 448, 73% active, melted, 120° F.] was weighed into the premix tank, followed by 2.68 parts of commercial 2-tallow-1-methyl-1-(tallow-amidoethyl) imidazoline methylsulfate [Varisoft-445, 78% active, melted, 120° F.]. Then 0.05 parts of dye solution was added [Geigy Polar Blue, 1% solution], and the premix was heated to 140° F. and agitated for 3–4 minutes by an air-driven mixer.

The complete composition was prepared as follows: 85.92 parts of city water [5–6 grains hardness/gallon] was metered into the mix tank and heated to 140° F. Then 0.0167 parts of 30% hydrogen peroxide solution and 0.0405 parts of 37% hydrochloric acid solution were added, with agitation, followed by addition of the heated softener premix prepared as described hereinbefore and 1.67 parts of commercial di-polyethoxy monoalkyl amine (Amiladin-D, 30% active, room temperature). Then 4.0 parts ethylene glycol and 0.17 parts perfume were added, following which the entire composition was cooled from 140° F. to 90° F. with continued agitation.

Example No. 1 had a pH of 4.7 and its physical stability at both ambient and elevated temperature was good. It was also tested and found excellent under freeze-thaw conditions as follows: (a) in 5 cycles alternating between 24 hours at 0° F. and 24 hours at 70° F.; (b) in 20 cycles alternating between 24 hours at 15° F. and 24 hours at 70° F.; and (c) in 5 cycles alternating between 3 days at 15° F. and 24 hours at 70° F.; the compositions thickened but did not gel.

Example No. 1 was tested for fabric softening on cotton terry cloths and T-shirts and polyester and acrylic swatches, and was tested for antistatic effects on the foregoing synthetic fibers. It was found to be excellent in all these respects in comparison with commercially marketed products.

EXAMPLES 2–5

The compositions of Examples 2–5 are within the scope of this invention; have good storage stability in relation to both elevated temperatures and freeze-thaw cycles; and have good fabric softening and antistat performance.

Table I

| Example No. | 2 | 3 | 4 | 5 |
|---|---|---|---|---|
| Composition (Wt.%) | | | | |
| Quat. Ammonium Salt | 9.6 a | 2.4 b | 3.2 c | 8.6 d |
| Quat. Imidazolinium Salt | 2.4 e | 1.6 f | 4.8 g | 3.4 h |
| Amine | 1.0 i | 0.2 j | 1.3 k | 0.4 m |
| Solvent | 1.0 n | 5.0 p | 3.0 q | 6.0 r |
| Water | balance | balance | balance | balance |
| pH | 4.0 s | 5.5 t | 3.5 u | 4.8 v |

Notes to Table I
a Tallow trimethyl ammonium chloride
b Ditallow dipropyl ammonium phosphate
c Dicoconut diethyl ammonium chloride
d Dihexadecyl dimethyl ammonium acetate
e 1-methyl-l[(stearoylamide) ethyl]-2-heptadecyl-4,5-dihydroimidazolinium chloride
g $R_7$ has 10 carbon atoms, $R_5$, $R_6$ and $R_8$ each have 4 carbon atoms; X is phosphate.
h $R_7$ and $R_8$ each have 20 carbon atoms; $R_5$ and $R_6$ each have 2 carbon atoms; X is phosphate.
i $R_9$ has 10 carbon atoms, and $(m + n) = 16$.
j $R_9$ has 20 carbon atoms, and $(m + n) = 30$.
k $R_9$ has 14 carbon atoms, and $(m + n) = 10$.
m $R_9$
is derived from tallow, and $(m + n) = 40$.
n $CH_3OH$
p $CH_2(OH)CH(OH)CH_2CH_3$
q $CH_3CH_2$ O $CH_2CH_2OH$
r $HO(CH_2CH_2O)_{10}H$
s hydrochloric acid used for pH adjustment.
t citric acid used for pH adjustment.
u orthophosphoric acid used for pH adjustment.
v sulfuric acid used for pH adjustment.

What is claimed is:

1. A liquid fabric conditioning composition comprising (a) from about 3% to about 12% by weight of the composition of cationic fabric conditioning agent comprising (i) quaternary ammonium salt, and (ii) quaternary imidazolinium salt, wherein the weight ratio of (i):(ii) is from about 1:1.5 to about 4:1;

(b) from about 0.2% to about 1.3% by weight of the composition of protonated di-polyethoxy monoalkyl amine;

(c) from about 1% to about 6% by weight of the composition of a lower alcohol; and (d) water; wherein the pH is from about 3.5 to about 5.5.

2. The fabric conditioning composition of claim 1 wherein component (a) is from 4% to 8% by weight of the composition and the weight ratio of (i):(ii) is from 1.5:1 to 2.5:1; wherein component (b) is from 0.4% to 1.0% by weight of the composition of protonated dipolyethoxy monoalkyl amine having the structural formula

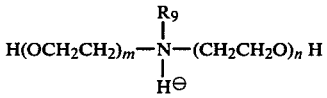

where R is an alkyl group having from about 10 to about 20 carbon atoms and where (m+n) is from about 10 to about 40; and wherein component (c) is from 3% to 5% by weight of the composition and is selected from the group consisting of monohydroxy alkanes having from 1 to about 6 carbon atoms, dihydroxy alkanes having from 2 to about 8 carbon atoms, and glycol ethers having from about 4 to about 16 carbon atoms.

3. The fabric conditioning composition of claim 1 wherein the pH is from 4.0 to 4.8.

4. The fabric conditioning composition of claim 2 wherein the pH is from 4.0 to 4.8.

5. The fabric conditioning composition of claim 2, 3, or 4 wherein (i) is ditallow dimethyl ammonium chloride; (ii) is 2-tallow-1-methyl-1-(tallow amidoethyl) imidazoline methyl sulfate; (b) is protonated di-polyethoxy monoalkyl amine wherein $R_9$ is an alkyl group derived from tallow and (m+n) is equal to 23; and (c) is ethylene glycol.

6. The fabric conditioning composition of claim 4 wherein component (a) is 4.0% ditallow dimethyl ammonium chloride plus 2.1% 2-tallow-1-methyl-1-(tallow amidoethyl) imidazoline methyl sulfate by weight of the composition; component (b) is 0.5% by weight of the composition of protonated di-polyethoxy monoalkyl amine wherein $R_9$ is an alkyl group derived from tallow and (m+n) is equal to 23; and component (c) is 4.0% ethylene glycol by weight of the composition.

7. A method for conditioning fabrics comprising the steps of:

(a) washing the fabrics;

(b) rinsing the fabrics in an aqueous bath containing the composition of claim 1, 3 or 4 in an amount sufficient to provide a concentration of cationic fabric conditioner of about 2 ppm to about 200 ppm by weight of the rinsing bath; and (c) drying the fabrics.

8. A method for conditioning fabrics comprising the steps of:

(a) washing the fabrics;

(b) rinsing the fabrics in an aqueous bath containing the composition hereinbelow defined in an amount sufficient to provide a concentration of cationic fabric conditioner of about 10 ppm to about 100 ppm by weight of the rinsing bath; and (c) drying the fabrics; wherein said composition comprises 4.0% ditallow dimethyl ammonium chloride; 2.1% 2-tallow-1-methyl-1-(tallow amidoethyl) imidazoline methyl sulfate; 0.5% protonated di-polyethoxy monoalkyl amine having the structure

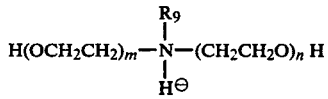

wherein R is an alkyl group derived from tallow and (m+n) is equal to 23; 4.0% ethylene glycol; and water; wherein all percentages are by weight based on the composition; and wherein the pH of the composition is from 4.0 to 4.8.

* * * * *